US006042398A

United States Patent [19]

Wu et al.

[11] Patent Number: 6,042,398

[45] Date of Patent: Mar. 28, 2000

[54] ELECTRICAL CONNECTOR HAVING IMPROVED GROUNDING ARRANGEMENT

[75] Inventors: Ming-Chuan Wu; Kevin Chou, both of Taipei Hsien, Taiwan

[73] Assignee: Hon Hai Precision Ind. Co., Ltd., Taipei Hsien, Taiwan

[21] Appl. No.: 09/218,779

[22] Filed: Dec. 22, 1998

[30] Foreign Application Priority Data

Jun. 6, 1998 [TW] Taiwan ..... 87208965

[51] Int. Cl.[7] ..... H01R 4/66

[52] U.S. Cl. ..... 439/101; 439/607

[58] Field of Search ..... 439/101, 677, 439/108, 607–610, 92, 95, 100

[56] References Cited

U.S. PATENT DOCUMENTS 5,547,385 8/1996 Spangler ..... 439/101

5,727,970 3/1998 Koguchi et al. ..... 439/607

5,915,976 7/1999 McHugh ..... 439/74

*Primary Examiner*—Paula Bradley

*Assistant Examiner*—P. Nguyen

[57] ABSTRACT

An electrical connector including a pair of grounding plate on two opposite sides thereof and a pair of brackets on two opposite ends thereof. The grounding plates each have a number of hooks on one end thereof in contact with corresponding grounding contacts and have a number of engaging fingers on an opposite end thereof. The grounding plates are further in contact with the brackets which are grounded to a circuit board on which the electrical connector is mounted. A connector assembly is also disclosed in which the grounding plates on one connector positively contact the grounding plates on the other connector to ensure a proper contacting engagement.

16 Claims, 7 Drawing Sheets

ELECTRICAL CONNECTOR HAVING IMPROVED GROUNDING ARRANGEMENT

BACKGROUND OF THE INVENTION

The present invention relates to electrical connectors and more particularly to board-to-board connectors having improved grounding design.

Board-to-board connectors are widely used for interconnection of one circuit board to another circuit board. One type of such connector assembly is disclosed in co-pending U.S. patent application Ser. No. 08/795,753, filed on Feb. 6, 1997 now U.S. Pat. No. 5,915,976 and assigned to the assignee hereof, and is further illustrated in FIGS. 6 and 7. As shown, the receptacle connector 1 comprises an insulative housing 11 and a pair of grounding plates 12 (only one being visible) attached to two opposite sides of the insulative housing 11. The grounding plate 12 has a number of engagement arms 122 each provided with kink 123. The mating plug connector 2 comprises a number of grounding contacts 213. In assembly, the engagement arms 122 of the grounding plate 12 of the receptacle connector 10 and the grounding contacts 213 of the plug connector 2 will contact with each other to establish a grounding shield. The entire specification of the above-said co-pending application is incorporated herein by reference.

In the above-said connector assembly, the plug connector is not provided with any grounding plate, like the grounding plate on the receptacle connector, such that under high frequency operations electromagnetic interference, electrostatic potential, etc. may cause adverse influence to the signal transmission. Further, it is noted that besides the two opposite sides of the insulative housing, no more other portions thereof are provided with any grounding arrangement. A more complete grounding or shielding arrangement is thus desired. Moreover, the contact condition between the grounding plate 12 of the receptacle connector 10 and the grounding contacts 213 of the plug connector 2 can be improved to provide a reliable and effective contact.

U.S. Pat. Nos. 5,697,799 and 5,746,622 issued to Consoli et al. disclose a shielded receptacle connector and a plug connector, respectively, which involve the provision of a shell member extending across mating face and side walls of individual insulative housing.

The present invention aims to provide an improved grounding arrangement which is simple in construction while effective in its intended purpose of shielding or grounding.

BRIEF SUMMARY OF THE INVENTION

One object of the present invention is to provide an electrical connector having an improved grounding shield.

In particular, the electrical connector comprises:

an insulative housing having a connector-mating face, a board-mounting face, two opposite sides, two opposite ends, and a plurality of slots formed on each side; a pair of brackets each mounted to one of the two ends of the insulative housing, the bracket having a pair of arms each extending over a portion of one side of the insulative housing;

a pair of grounding plates each secured to one side of the insulative housing and overlapping the arms of the brackets on the one side of the insulative housing, the grounding plate having a plurality of hooks each received within one of the plurality of slots of the insulative housing; and a plurality of contacts received in the insulative housing, each contact having a solder tail extending outward from the board-mounting face over the sides of the insulative housing, a corresponding number of contacts being aligned with and contacting the plurality of hooks of the grounding plate.

Another object of the present invention is to provide an electrical connector assembly having improved grounding or shielding arrangement. In particular, the connector assembly comprises an electrical connector substantially constructed above and a mating electrical connector similarly constructed. Each connector has grounding plates on sides thereof. The grounding plates of one connector each have a plurality of engaging fingers designed to effectively contact engaging fingers of the mating connector.

Other objects, advantages and novel features of the invention will become more apparent from the following detailed description when taken in conjunction with the accompanying drawings.

DETAILED DESCRIPTION OF THE INVENTION

Figure 1:
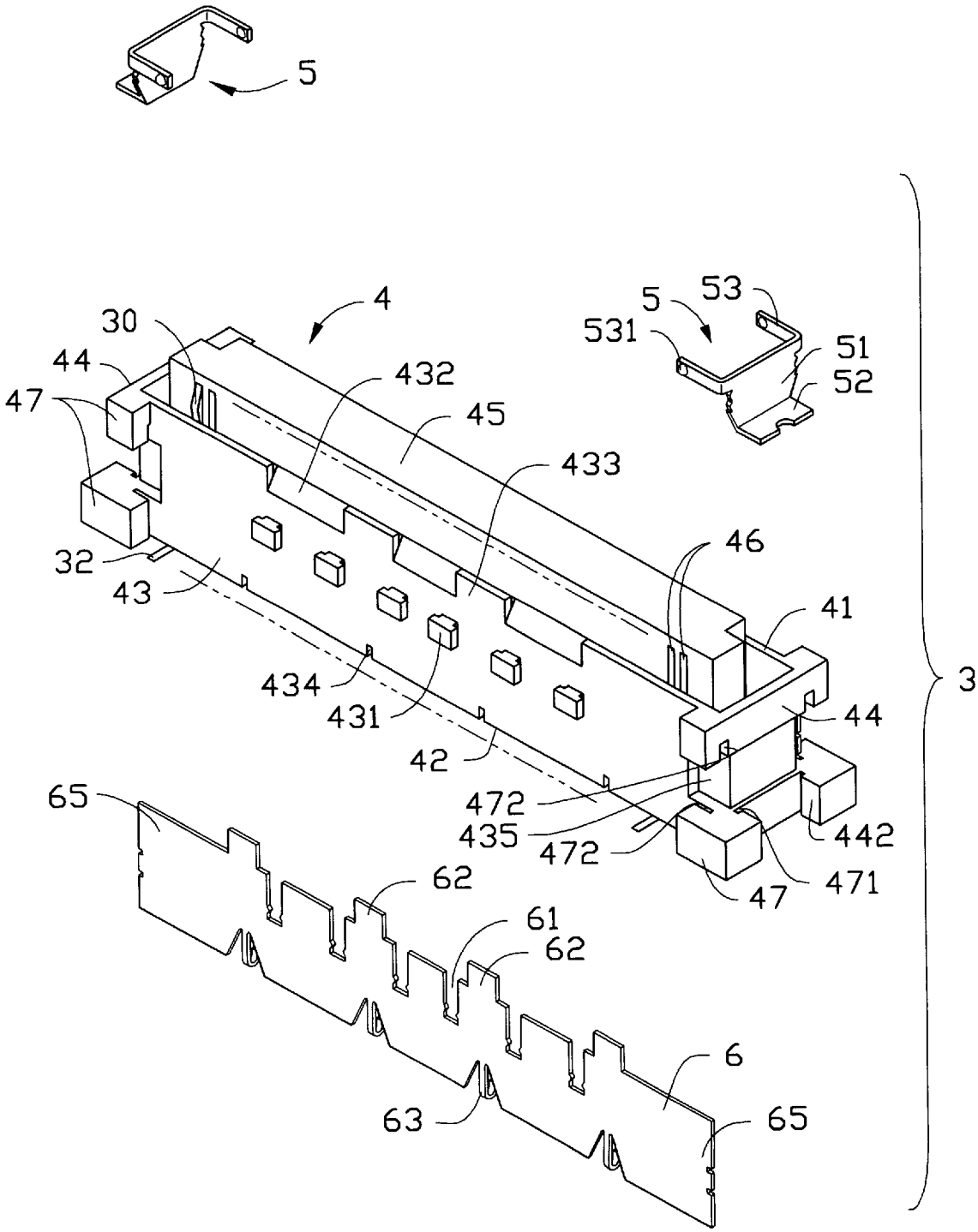
FIG. 1 is an exploded perspective view of an electrical connector in accordance with the present invention.
Figure 2:
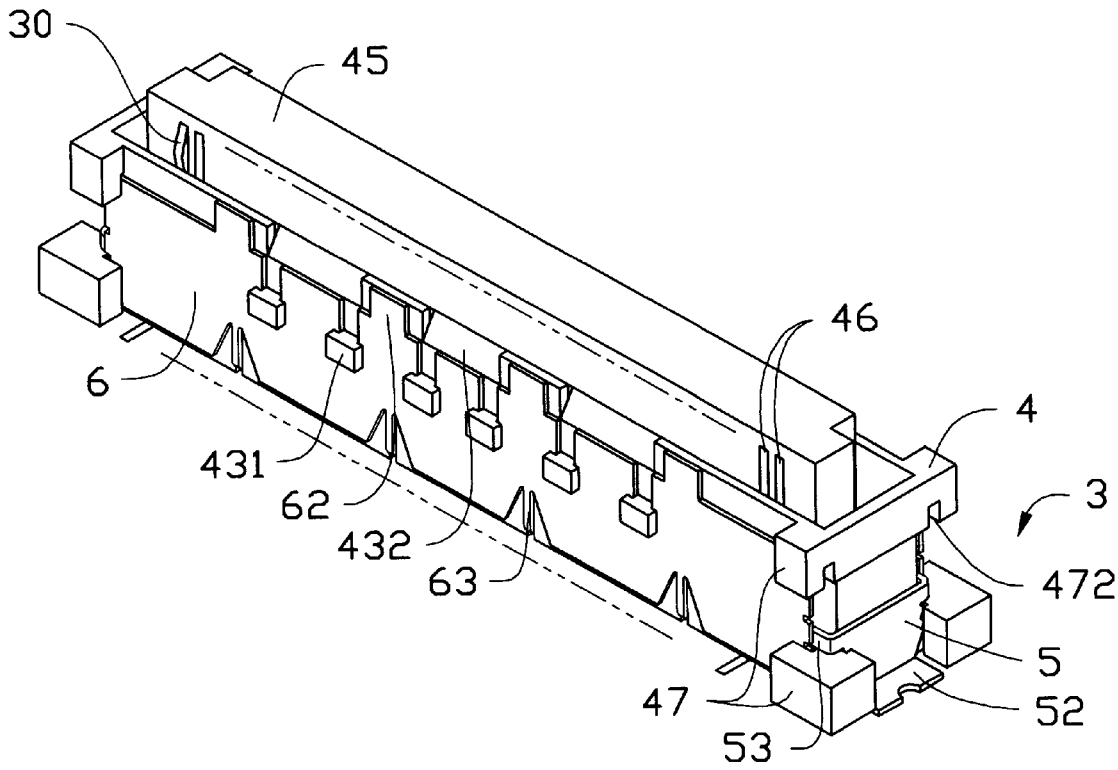
FIG. 2 is a perspective view of the electrical connector of FIG. 1.

Referring initially to FIGS. 1 and 2, an electrical connector 3 in accordance with the present invention generally comprises an insulative housing 4, a pair of brackets 5, a pair of grounding plates 6 (only one being shown in the figures), and a plurality of contacts 30. The insulative housing 4 has a connector-mating face 41, a board-mounting face 42, two opposite sides 43, two opposite ends 44, and a plurality of slots 434 formed on each side 43. The housing 4 further has a central block 45 forming a plurality of passageways 46 thereon for accommodating a corresponding number of contacts 30. Although not shown, it is noted that the housing 4 is substantially hollow at the board-mounting face 42 so that the slots 434 are formed on the wall where the sides 43 are located. Further, each side 43 has a plurality of alternating notches 432 and protrusions 433 at a portion near the connector-mating face 41.

The bracket 5 is mounted to the end 44 of the insulative housing 4. The bracket 5 has a pair of arms 53 each extending over a portion of one side 43 of the insulative housing 4. For mounting the bracket 5 to the housing 4, an opening 442 is formed on each end 44 of the insulative housing 4 and two opposed grooves 471 are defined within the opening 442. The bracket 5 has a main portion 51 which then may be secured in the two opposed grooves 471 and a solder tail 52 for connection with a printed circuit board (not shown). It is noted that the solder tail 52 will be suitably grounded to the circuit board. With the main portion 51 exposed to outside through the opening 442, a good grounding and shielding effect may be expected. To suitably position the arms 53 with respect to the housing 4 and the grounding plate 6, a recessed portion 435 is formed between an intersection of each side 43 and each end 44 of the insulative housing 44 and one arm 53 of the bracket 5 extends in the recessed portion 435 and substantially lies flush with a surface of the side 43.

Figure 3:
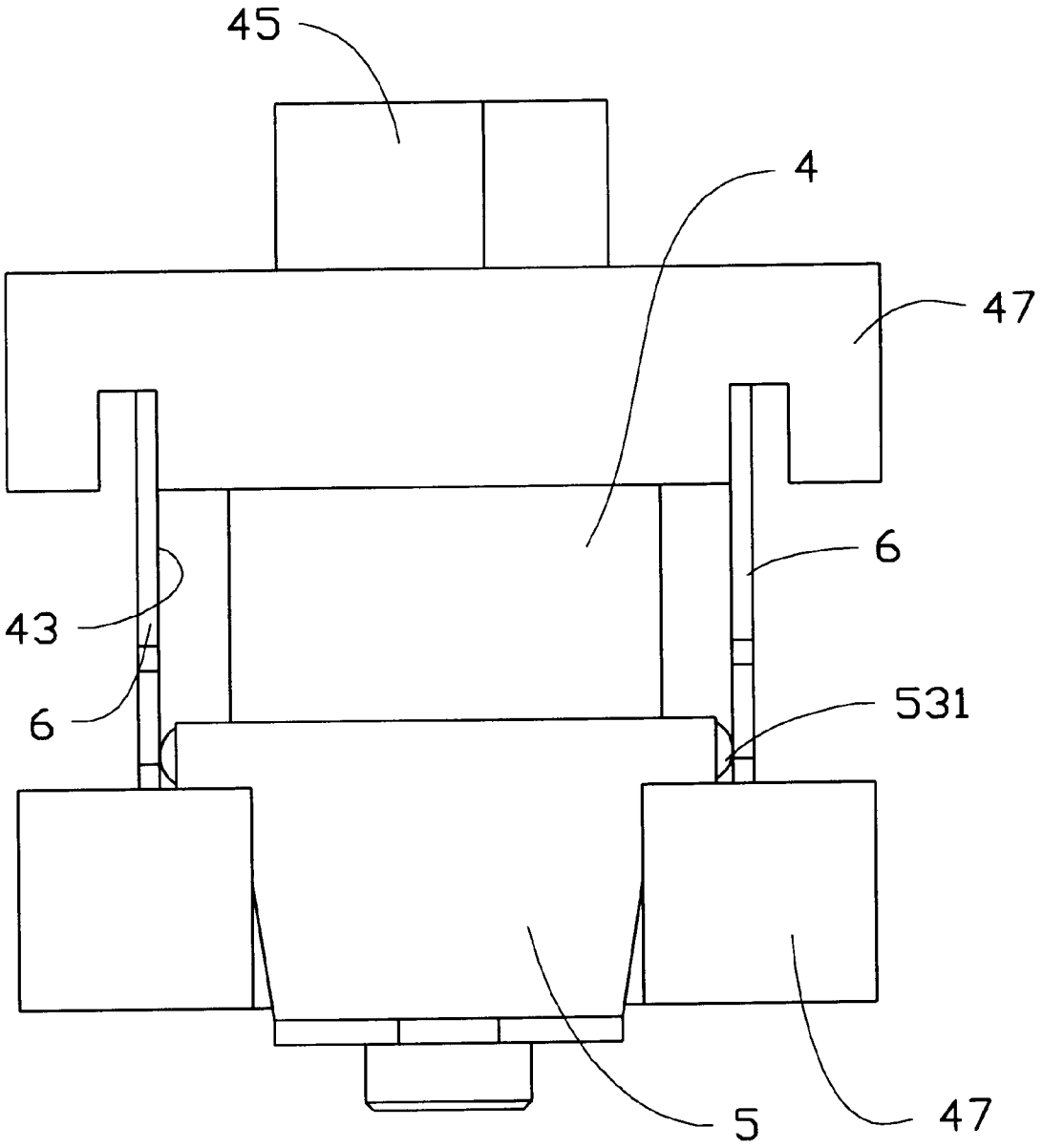
FIG. 3 is a side view of the electrical connector shown in FIG. 2.
Figure 4:
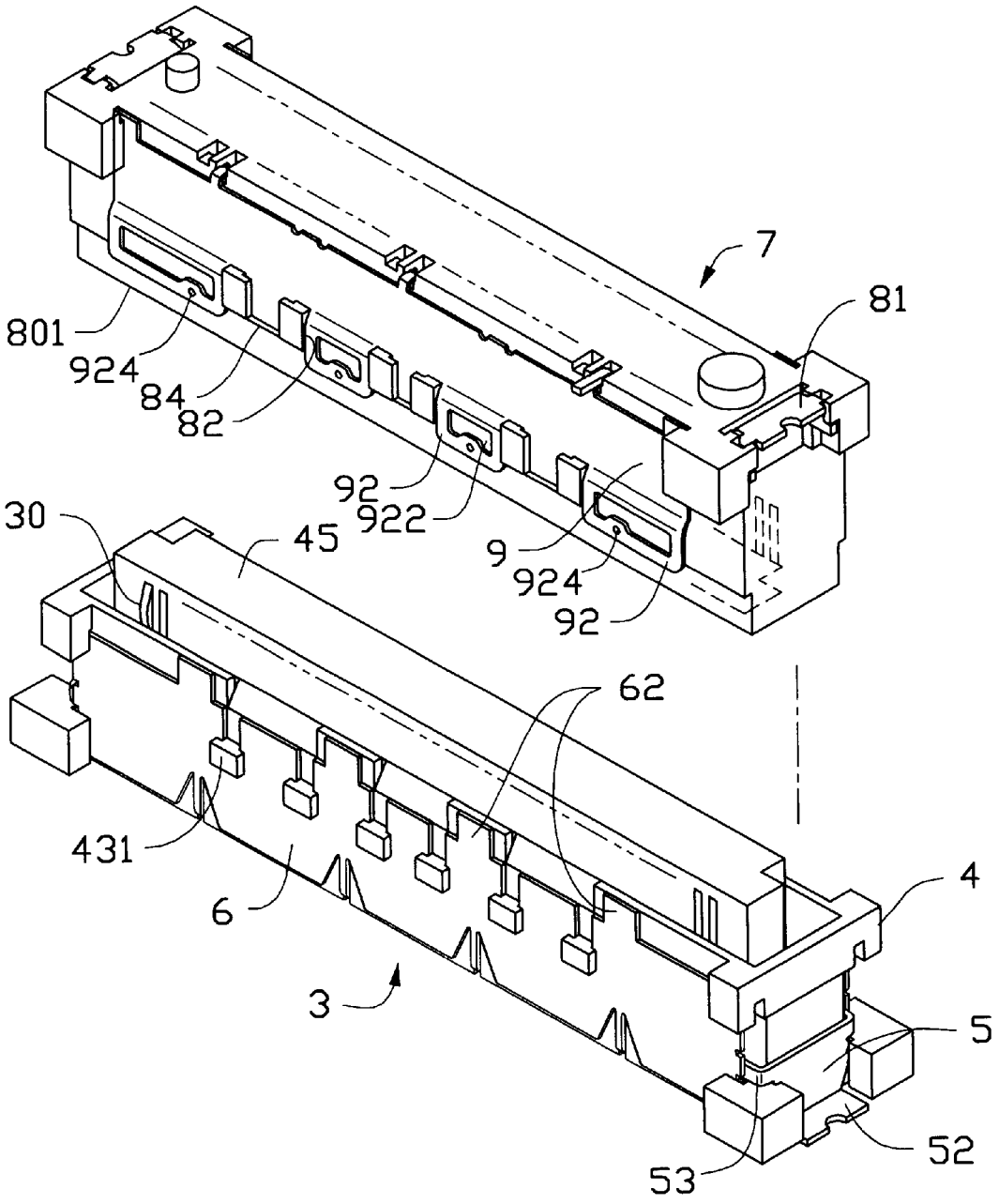
FIG. 4 is a perspective view showing the electrical connector of FIG. 2 and a mating electrical connector.
Figure 5:
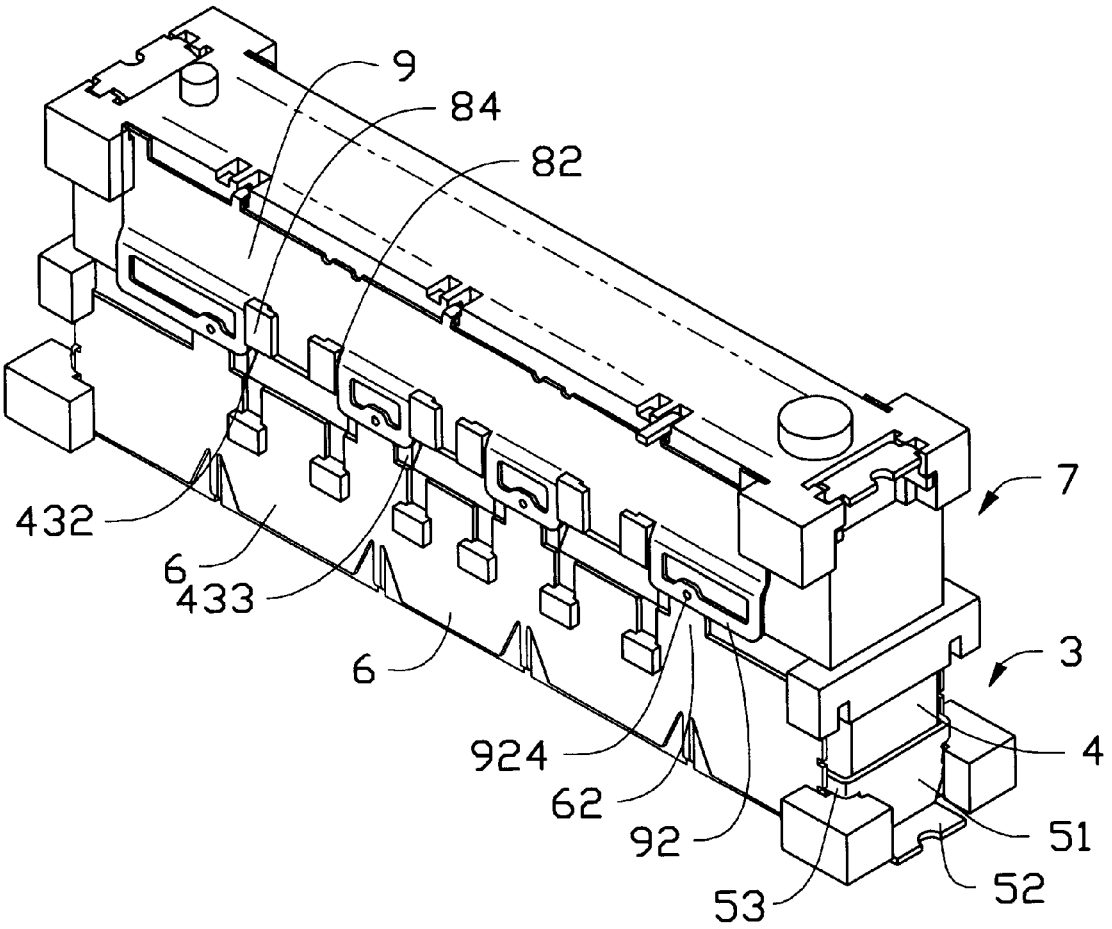
FIG. 5 is a assembled perspective view of the electrical connectors shown in FIG. 4.
Figure 6:
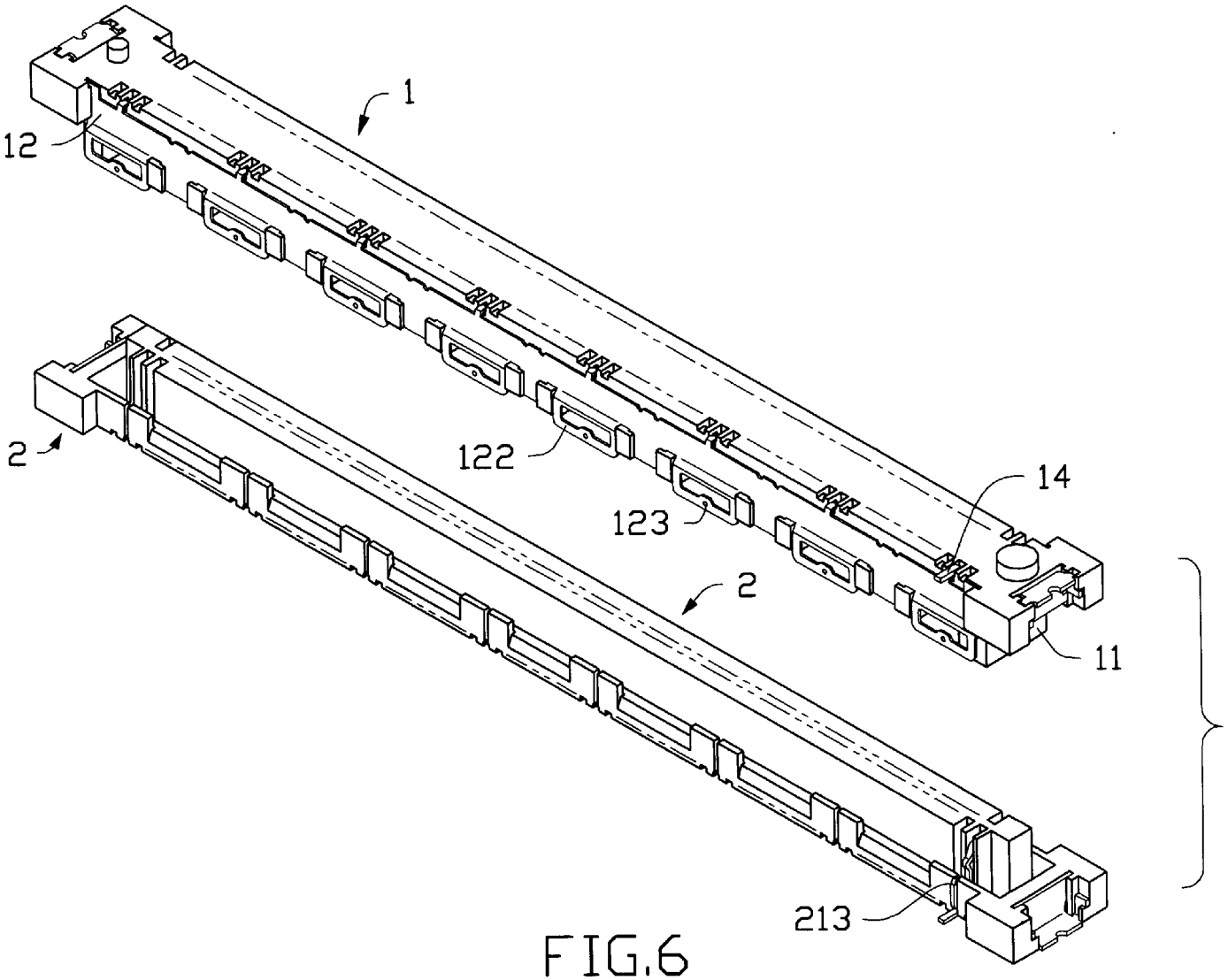
FIG. 6 shows an electrical connector assembly described in co-pending U.S. patent application Ser. No. 08/795,753 now U.S. Pat. No. 5,915,976.
Figure 7:
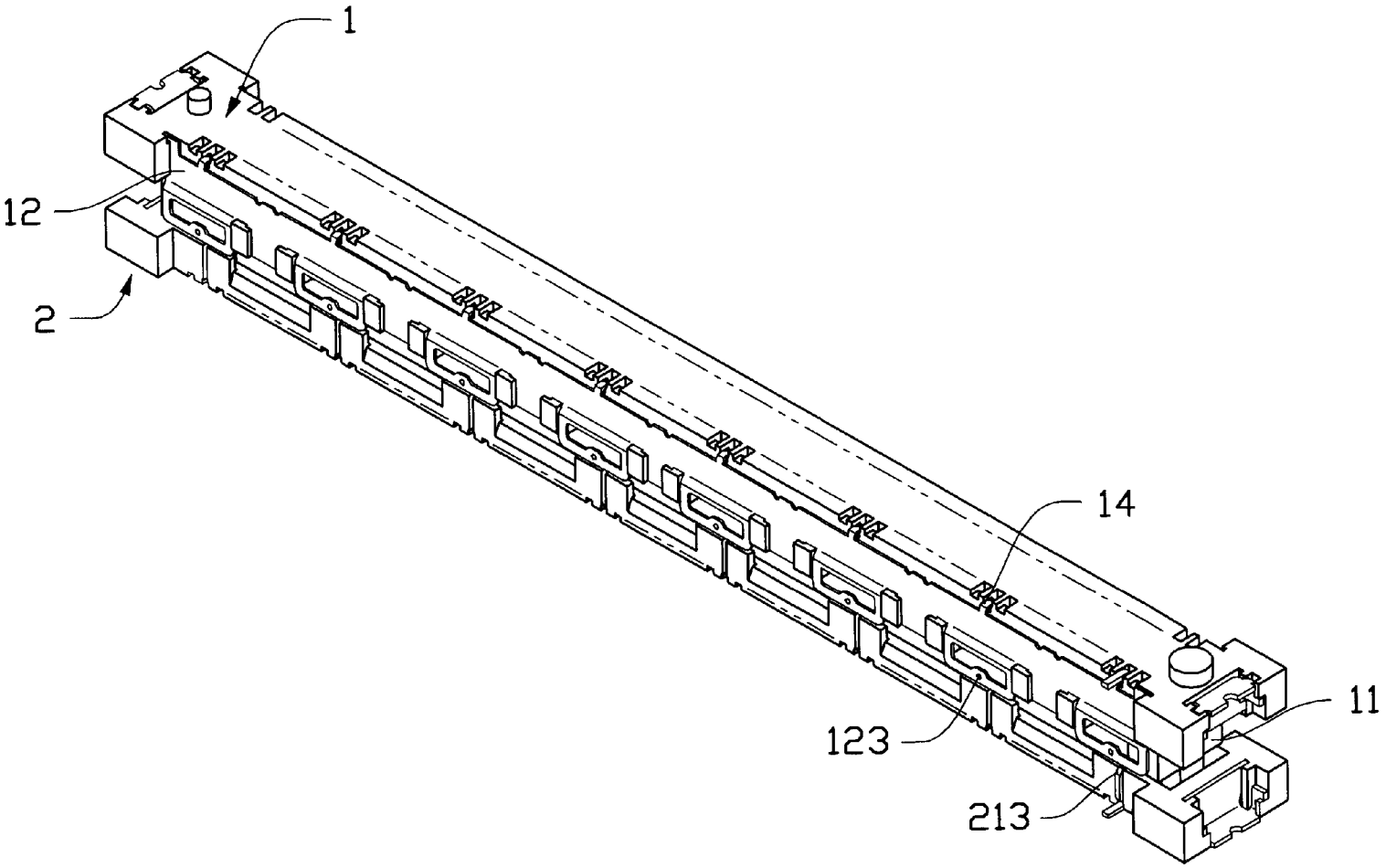
FIG. 7 is an assembled perspective view of the electrical connector assembly shown in FIG. 6.

The grounding plate 6 is secured to one side 43 of the insulative housing 4 and in so doing overlaps the arms 53 of the brackets 5 on the same side 43 of the insulative housing 4. The grounding plate 6 has a plurality of hooks 63 each received within one of the plurality of slots 434 of the insulative housing 4. With the contacts 30 mounted to the housing 4, solder tail 32 of the contact 30 that extends outward from the board-mounting face over the sides 43 of the insulative housing 4 for connection to a circuit board is so arranged as to be aligned with and contact the plurality of hooks 63 of the grounding plate 4. In the embodiment shown, four hooks 63 are provided so that corresponding solder tail 32 of four contacts 30 will be in contact therewith. To ensure a proper contact between the arm 53 and the grounding plate 6, a bulge 531 is formed on each arm 53 for contacting the grounding plate 6, as clearly seen in FIG. 3. A plurality of T-shaped lugs 431 are formed on each side 43 of the insulative housing 4 and a corresponding number of slits 61 are formed on the grounding plate 6 for clamping onto the T-shaped lugs 431. To aid in securing the grounding plate 6 to the housing 4, a plurality of protruding blocks 47 are formed on the side 43 of the insulative housing 4. Each protruding block 47 and corresponding side 43 define a recess 472 therebetween so that two opposite ends 65 of the grounding plate 6 may be secured within the recesses 472. FIG. 4 shows the electrical connector 3 described above and a mating electrical connector 7. FIG. 5 shows an assembled view of the two connectors. In the embodiment of the invention, the connector 3 is constructed as a plug connector and the mating connector 7 is therefore a receptacle connector. Further, the mating connector 7 has a substantially same structure as the receptacle connector I shown in FIG. 6, except for its overall height, although its components are differently labeled. It is noted that although the bracket 81 on the receptacle connector 7 as shown is not constructed in a same way as the bracket 5 of the plug connector 3, i.e., it does not have arms for grounding purpose, it clearly is envisioned or contemplated. Receptacle connector 7 is described in greater detail in U.S. patent application Ser. No. 08/795,753 filed Feb. 6, 1997 now U.S. Pat. No. 5,915,976 and assigned to the assignee hereof.

The receptacle connector 7 also has a plurality of alternating notches 82 and protrusions 84 on its side at a portion near the connector-mating face 801. The notches and protrusions on the two connectors 3 and 7 are, however, situated oppositely as to their positions so that the notches on one connector are aligned with the protrusions on the other connector. For example, as clearly shown in FIG. 5, the notch 432 on the plug connector 3 is aligned with the protrusion 84 on the receptacle connector 7; the notch 82 on the receptacle connector 7 is aligned with the protrusion 433 on the plug connector 3.

The grounding plate 6 has a number of engaging fingers 62 exposed or extending to the protrusions 433 (cf. FIG. 2) and the grounding plate 9 has a number of engaging fingers 92 exposed to the notches 82. This arrangement can be reversed, i.e., the engaging fingers 62 of the grounding plate 6 may be exposed to the notches 432 while the engaging fingers 92 of the grounding plate 9 may be exposed or extended to the protrusions 84. With this arrangement, when the two connectors are assembled together, their fingers 62 and 92 will contact each other. More importantly, since the engaging fingers of one grounding plate (fingers 62 in the embodiment shown) are exposed to protrusions (protrusions 433 in the embodiment shown), when engaged with and therefore pressed by the engaging fingers of the other grounding plate (fingers 92 in the embodiment shown), the engaging fingers 62 will bear against the protrusions 433, thereby achieving a positive and firm engagement between the fingers 62 and 92.

To increase a resiliency of the engaging finger 92 exposed to the notches 82 of the housing 8, a hole 922 is formed on the finger 92. Further, the engaging finger 92 may have a bulge 924 on a surface facing the finger 62 for ensuring a proper contact.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a connector-mating face, a board-mounting face, two opposite sides, two opposite ends, and a plurality of slots formed on each side;

a pair of brackets each mounted to one of the two ends of the insulative housing, the bracket having a pair of arms each extending over a portion of one side of the insulative housing;

a pair of grounding plates each secured to one side of the insulative housing and overlapping and engaging the arms of the brackets on the one side of the insulative housing, the grounding plate having a plurality of hooks each received within one of the plurality of slots of the insulative housing; and a plurality of contacts received in the insulative housing, each contact having a solder tail extending outward from the board-mounting face over the sides of the insulative housing, a corresponding number of contacts being aligned with and contacting the plurality of hooks of the grounding plate.

2. The electrical connector as claimed in claim 1, wherein:

an opening is formed on each end of the insulative housing and two opposed grooves are defined within the opening; and the bracket has a main portion secured in the two opposed grooves and exposed to outside through the opening.

3. The electrical connector as claimed in claim 1, wherein:

a recessed portion is formed between an intersection of each side and each end of the insulative housing and one arm of the bracket extends in the recessed portion and substantially lies flush with a surface of the side.

4. The electrical connector as claimed in claim 3, wherein a bulge is formed on each arm of the bracket for contacting the grounding plate.

5. The electrical connector as claimed in claim 1, wherein:

a plurality of T-shaped lugs are formed on each side of the insulative housing; and a corresponding number of slits are formed on the grounding plate for clamping onto the T-shaped lugs.

6. The electrical connector as claimed in claim 5, wherein:

a plurality of protruding blocks are formed on the side of the insulative housing, each protruding block and the side defining a recess therebetween; and two opposite ends of the grounding plate are secured within the recesses.

7. An electrical connector assembly comprising:

a first connector and a second connector, each connector comprising:

an insulative housing having a connector-mating face, a board-mounting face, two opposite sides, two opposite ends, and a plurality of slots formed on each side, each side having a plurality of alternating notches and protrusions at a portion near the connector-mating face and the notches on one connector being aligned with the protrusions on the other connector;

a pair of grounding plates each secured to one side of the insulative housing, the grounding plate having a plurality of hooks each received within one of the plurality of slots of the insulative housing; and a plurality of contacts received in the insulative housing, each contact having a solder tail extending outward from the board-mounting face over the sides of the insulative housing, a corresponding number of contacts being aligned with and contacting the plurality of hooks of the grounding plate;

at least one of the first connector and the second connector comprising:

a pair of brackets each mounted to one of the two ends of the insulative housing, the bracket having a pair of arms each extending over a portion of one side of the insulative housing and contacting the grounding plate; and the grounding plates of one connector each having a plurality of engaging fingers exposed to the notches and the grounding plates of the other connector each having a plurality of engaging fingers exposed to the protrusions to align and contact with the engaging fingers on the one connector.

8. The electrical connector assembly as claimed in claim 7, wherein the engaging fingers exposed to the notches each have a hole to increase a resiliency of the engaging finger.

9. The electrical connector assembly as claimed in claim 7, wherein the engaging fingers exposed to the notches on one connector each have a bulge for contacting the engaging fingers on the other connector.

10. The electrical connector as claimed in claim 7, wherein:

an opening is formed on each end of the insulative housing and two opposed grooves are defined within the opening; and the bracket has a main portion secured in the two opposed grooves and exposed to outside through the opening.

11. The electrical connector as claimed in claim 7, wherein:

a recessed portion is formed between an intersection of each side and each end of the insulative housing and one arm of the bracket extends in the recessed portion and substantially lies flush with a surface of the side.

12. The electrical connector as claimed in claim 11, wherein a bulge is formed on each arm of the bracket for contacting the grounding plate.

13. The electrical connector as claimed in claim 7, wherein:

a plurality of T-shaped lugs are formed on each side of the insulative housing; and a corresponding number of slits are formed on the grounding plate for clamping onto the T-shaped lugs.

14. The electrical connector as claimed in claim 13, wherein:

a plurality of protruding blocks are formed on the side of the insulative housing, each protruding block and the side defining a recess therebetween; and two opposite ends of the grounding plate are secured within the recesses.

15. An electrical connector comprising:

an insulative housing defining two opposite sides and two opposite ends;

a pair of brackets each mounted to one of the two ends of the insulative housing and including a vertical main portion, a horizontal solder tail at a bottom, and at least one arm extending along a lengthwise direction of the housing; and at least one grounding plate extending along and secured to one side of the insulative housing, and mechanically and electrically engaged with said arm of the bracket.

16. The electrical connector as claimed in claim 15, wherein said arm is supportably seated on a protrusion of the housing thereabouts.

* * * * *